United States Patent [19]

Valdivia

[11] Patent Number: 4,901,927

[45] Date of Patent: Feb. 20, 1990

[54] DUAL SHOWER HEAD ASSEMBLY

[76] Inventor: Jesse Valdivia, 6627 Crossway Dr., Pico Rivera, Calif. 90660

[21] Appl. No.: 309,832

[22] Filed: Feb. 13, 1989

[51] Int. Cl.[4] ..... B05B 1/16

[52] U.S. Cl. ..... 239/446; 4/601; 137/883; 137/887; 239/282; 239/574; 239/581.1; 239/587

[58] Field of Search ..... 239/282, 283, 443–447, 239/551, 562, 574, 581.1, 587, DIG. 1; 4/567, 601, 615; 137/883, 887; 251/309

[56] References Cited

U.S. PATENT DOCUMENTS

| | | | |
|---|---|---|---|
| 1,222,726 | 4/1917 | Brickell | 239/562 |
| 1,354,838 | 10/1920 | Perkins | 239/587 |
| 1,616,514 | 2/1927 | Swimmer | 4/601 |
| 1,758,115 | 5/1930 | Kelly | 239/282 |
| 2,043,714 | 6/1936 | Schellin | 239/447 |
| 3,112,073 | 11/1963 | Larson et al. | 239/446 |
| 3,685,745 | 8/1972 | Peschcke-Koedt | 239/587 |
| 3,822,826 | 7/1974 | Wilson | 239/282 |
| 4,413,362 | 11/1983 | Chianco et al. | 4/615 |

*Primary Examiner*—Andres Kashnikow
*Assistant Examiner*—Michael J. Forman
*Attorney, Agent, or Firm*—Lyon & Lyon

[57] ABSTRACT

A dual shower head assembly for use in personal showers to allow two people to shower independently at the same time, one person to shower in a conventional manner or one person to shower with two separate sprays. The assembly includes an upper shower head, a lower shower head, a substantially "S"-shaped connecting conduit, a diverter valve assembly and an adjustable shut-off valve. The diverter valve assembly is adapted for threaded engagement with the water supply pipe protruding from the shower wall and defines a pair of water outlets, one of which communicates with and is pivotally connected to the lower end of the connecting conduit. The shut-off valve is carried by the diverter valve assembly and communicates with the other of the water outlets in the diverter valve for selectively allowing water flow therethrough. The lower shower head communicates with and is pivotally mounted on the shut-off valve, downstream of the diverter valve. The upper shower head communicates with and is pivotally mounted on the upper end of the connecting conduit. The diverter valve restricts the flow of water and selectively allows water passing therethrough from the water supply pipe to flow only to the shut-off valve or both to the shut-off valve and to the connecting conduit whereby through the coordination of the diverter valve assembly and the shut-off valve, water can be directed to spray only through said lower first shower head, only through said upper shower head, through both shower heads concurrently or through neither shower head. The pivotal mounting of the individual shower heads and "S"- shaped configuration of the connecting conduit provides a substantial flexibility in the positioning of the water spray or sprays for one or two persons.

7 Claims, 1 Drawing Sheet

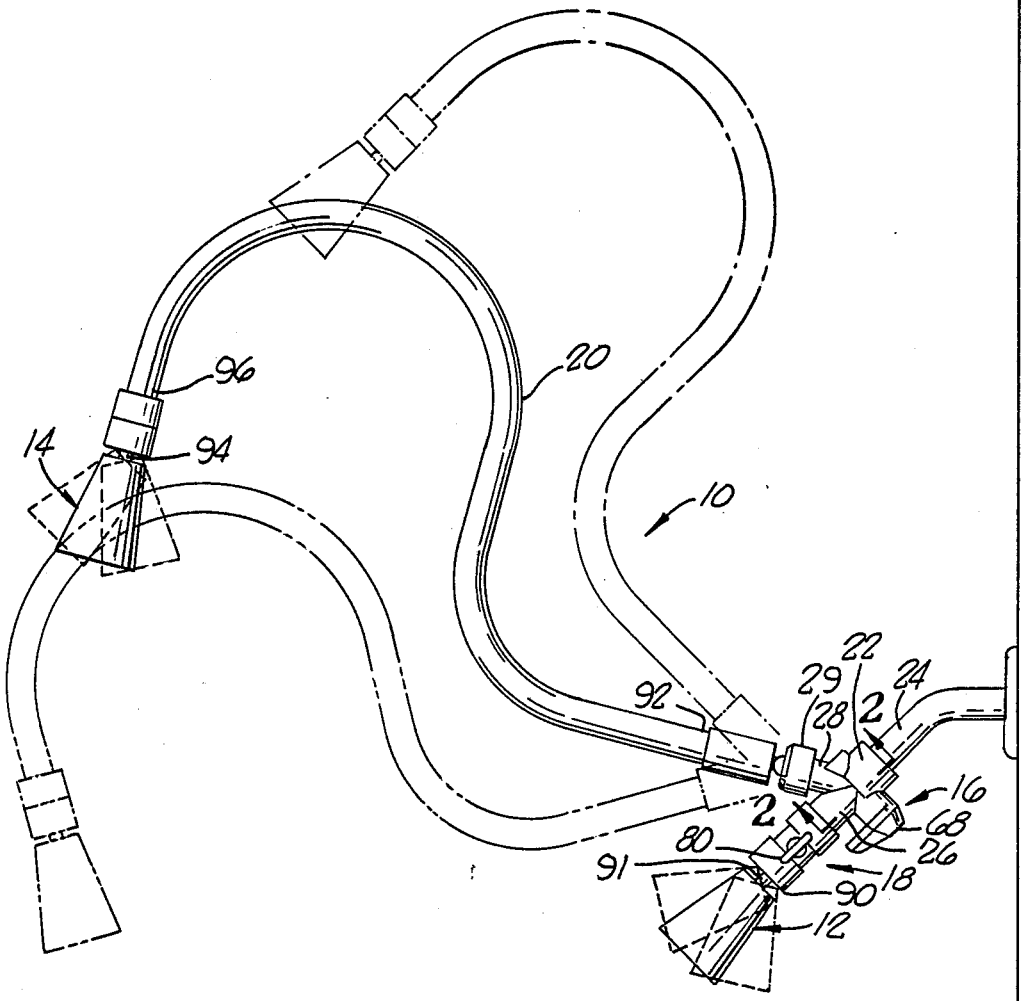
FIG. 1.
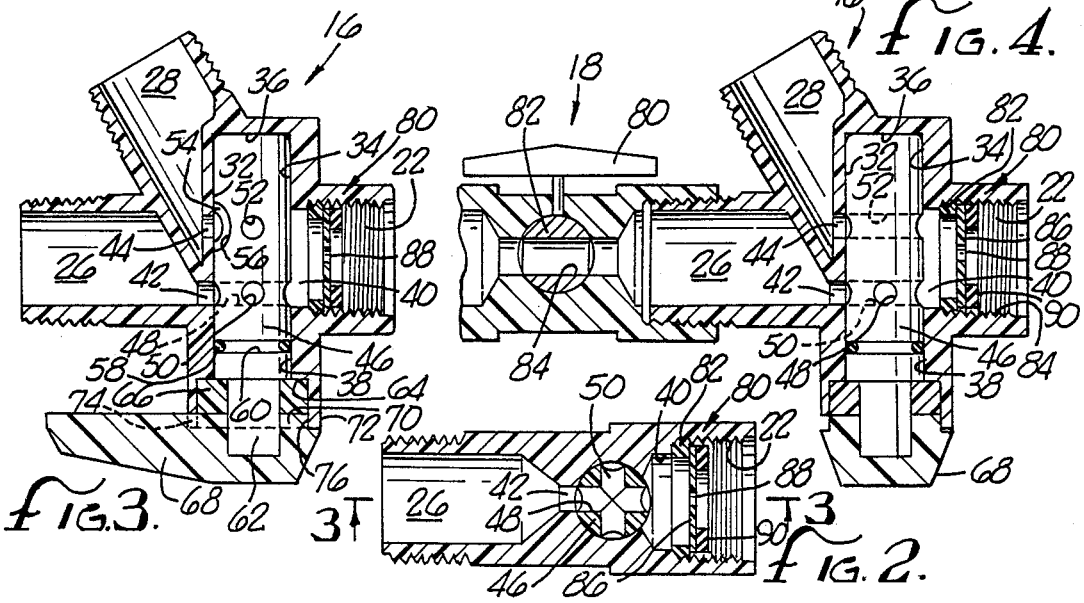
FIG. 3.
FIG. 4.
FIG. 2.

DUAL SHOWER HEAD ASSEMBLY

BACKGROUND OF THE INVENTION

Today, time and water are in short supply. While recent years have seen considerable attention focused on water conservation, one of the more inefficient uses of water in the home is still the personal shower. A great majority of all personal showers employ only a single head, allowing only one person to shower at a time. In addition, such showers generally do not employ features which address newly established water conservation codes. As a result, considerable water is needlessly wasted during the showering process. Various efforts to reduce water use in personal showers have been made, such as the use of low flow volume heads and flow interrupting shut-off valves. Such devices still permit only a single person to shower comfortably at a given time. While a number of dual or multi-head shower configurations have been designed, they are generally designed to provide a plurality of differently directed sprays for a single person and are ill suited for use by two persons showering concurrently. Those configurations designed for use by more than one person at a given time have heretofore proved largely unsuccessful primarily due to their limited versatility and attachment means.

Examples of multiple head shower devices are seen in U.S. Pat. Nos. 3,822,826, 3,913,839, 3,121,235, and 3,971,074. The first two patents each teach an attachment assembly for use by two people concurrently wherein two shower heads are mounted on a horizontal conduit extending between the walls of a shower/bath tub enclosure. Such devices do not provide any vertical adjustment for persons of different heights, presents an obstruction to the user's heads, are generally unsightly and, cannot be used in a shower stall where there is no wall opposite the water supply pipe to which the device is secured. In addition, such devices do not employ water-saving features.

U.S. Pat. Nos. 3,971,074 and 3,121,235 employ a multiple number of shower heads for providing a plurality of differently angled sprays for a single person. They will not comfortably accommodate more than one person at a time and thus provide little or no water savings. U.S. Pat. No. 3,121,235 provides several shower heads extending from a vertically mounted pipe communicating with the shower's water supply pipe. While the individual shower heads are mounted at different heights along the vertical pipe, they do not have the flexibility necessary for convenient use by two people concurrently. The upper most head, while extending outwardly from the vertical pipe, is below the water supply pipe in the wall and thus does not provide the necessary spray angle to reach a second person within the shower enclosure. In addition, such a device intrudes both into the shower area and into the bath tub rendering a permanent installation of such a device very undesirable. U.S. Pat. No. 3,971,074 provides a number of shower heads, all of which are designed to converge on a single person. Like the device of the preceding patent, this arrangement is also very intrusive into the shower area and is generally unsightly. The dual shower head configuration of the present invention overcomes these deficiencies and provides a space efficient, water-saving configuration highly suitable for concurrent use by two people and, if desired, two adjustable sprays for use by a single person.

SUMMARY OF THE INVENTION

Briefly, the invention comprises a versatile, water-saving shower head assembly for use in personal showers to allow two people to shower independently at the same time or one person with either a single or two separate sprays. The assembly includes a pair of shower heads pivotally mounted adjacent the extended ends of an upstanding substantially "S"-shaped conduit so as to define an upper shower head and a lower shower head. A diverter valve is disposed adjacent the lower shower head for limiting the flow of water and selectively allowing water flow either solely through the lower shower head or through both the upper and lower shower head and an adjustable flow control shut off valve is disposed between the lower shower head and the diverter valve for selectively allowing water flow to the lower shower head. Through coordination of the diverter valve and shut-off valve, water can be directed to spray only through the lower shower head, only through the upper shower head, through both shower heads concurrently, or through neither shower head. The pivotal mounting of the individual shower heads and the substantially S-shaped conduit provide a substantial flexibility in the positioning of water spray or sprays for one or two persons of varying heights.

It is the principal object of the present invention to provide a versatile water-saving shower head assembly for use in personal showers to allow two people to shower independently at the same time, one person to shower in a conventional manner or one person to shower with two separately adjustable sprays.

It is another object of the present invention to provide a dual shower head assembly which effectively limits the total water flow rate to meet conservation codes and evenly distributes the total allowable flow between two individuals showering simultaneously.

It is a further object of the present invention to provide a dual shower head assembly wherein the orientation of the individual shower head and the relative orientation between the two shower heads is readily adjustable for convenient use by two persons at the same time and for individuals of varying heights.

It is yet another object of the present invention to provide a dual shower head assembly for use in personal showers which requires solely the support of a conventional shower supply pipe outlet for mounting the assembly within the shower area.

It is yet another object of the present invention to provide a dual shower head assembly which can be used in a wide variety of shower stalls and tub enclosures without modification or adjustment.

It is yet another object of the present invention to provide a dual shower head assembly for allowing two people to shower independently at the same time without creating an obstruction within the shower enclosure.

These other objects and advantages will become ratherly apparent from the following detailed description taken in conjunction with the accompanying drawing.

DESCRIPTION OF THE PREFERRED EMBODIMENT IN THE DRAWINGS

FIG. 1 is a side view of the dual shower head assembly of the present invention mounted in a shower enclosure and illustrating the pivotal movement of the assembly in phantom lines.

FIG. 2 is a sectional view taken along line 2—2 in FIG. 1.

FIG. 3 is a sectional view of the diverter valve employed in the present invention.

FIG. 4 is a sectional view of the diverter valve and shut-off valve employed in the present invention.

Referring now in detail to the drawings, the shower head assembly 10 of the present invention includes a first lower shower head 12, a second upper shower head 14, a diverter valve 16, an adjustable flow control shut-off valve 18 and a substantially "S"connecting conduit 20. Diverter valve 16 defines a cylindrical threaded fluid inlet 22 adapted to be threadably engaged with a conventional shower supply pipe 24, a first fluid outlet 26 axially aligned with inlet 22 and adapted for threaded engagement with shut-off valve 18, a second fluid outlet 28 angularly disposed with respect to said first outlet 26 and adapted for threaded engagement with a ball joint 29, and a vertical cylindrical wall 32 disposed between fluid inlet 22 and outlet 28 and defining a chamber 34 therein. A flow restrictor 80 is disposed in the downstream end of the fluid inlet 22. Flow restrictor 80 comprises rigidly secured disc member 86 having a centrally disposed aperture 88 therein to restrict the fluid flow through the diverter valve and a resilient washer 90 disposed adjacent disc 86. If desired for construction purposes, an annular disc support member 82 can be rigidly secured within the fluid inlet 22 adjacent the downstream side of disc 86. It is important that support member 82, if utilized, be rigidly secured within inlet 22 to avoid being drawn into the interior of the diverter valve 16.

Chamber 34 within diverter valve 16 has a Closed upper end 36 and an open lower end 38. Cylindrical wall 32 defines an elongated fluid inlet aperture 40 therein communicating the fluid inlet 22 of the diverter valve 16 with chamber 34. A first fluid outlet aperture 42 is disposed in cylindrical wall 32 across chamber 34 from inlet aperture 40 for the passage of water from fluid inlet 22, through flow restrictor 80 and chamber 34 to said first fluid outlet 26. A second fluid outlet aperture 44 is disposed in cylindrical wall 32 above aperture 42 therein for communicating chamber 34 with the second fluid outlet 28.

A cylindrical flow director 46 is disposed within chamber 34 for selectively communicating the fluid inlet 22 of the diverter valve 16 with either or both of the fluid outlets 26 or 28. Flow director 46 defines a first slot 48 extending radially therethrough. When the flow director 46 is in a first position shown in FIG. 3, slot 48 is in axial alignment with both fluid inlet aperture 40 and the first fluid outlet aperture 42, whereby upon disposing the flow director 46 in said first position, water flow passes from the fluid inlet 22, through slot 48 in the flow director 46 and outwardly of the diverter valve 16 through fluid outlet 26. A second slot 50 extends radially through flow director 46, with the central axis thereof intersecting and being perpendicularly disposed with respect to the central axis of slot 48. A third slot 52 extends radially through flow director 46 above slot 50 such that the central axis of slot 52 is parallel to the central axis of slot 50. Upon rotating the flow director 46 ninety degrees to a second position (see FIG. 4), slot 50 communicates the fluid inlet 22 with fluid outlet 2 while slot 52 communicates the fluid inlet with the second outlet 28.

A first O-ring 54 is disposed in an annular groove 56 in the exterior surface of flow director 46 perpendicular to the longitudinal axis of slot 52 so as to position O-ring 54 about the second fluid outlet aperture 44 when the flow selector is in said first position to effectively seal the second fluid outlet 28 from fluid inlet 22. A second O-ring 58 is disposed within an annular groove 60 about the lower portion of flow director 46 to prevent water from passing out the lower open end 38 of the diverter valve 16. The lower portion 62 of the cylindrical flow director 46 is of a reduced diameter to define an annular shoulder 64 which abuts an annulus 66 fixed in the lower end 38 of the flow director for retaining the flow director within the diverter valve. A handle 68 is affixed to the lower end 62 of the flow director for rotating the flow director between the first and second positions and a recess area 70 is provided in the lowermost end 72 of cylindrical wall 32 so as to define stops rotation of the flow director 46 within a chamber 34 to the first and second positions. Accordingly, by positioning handle 68 against stop 74 the flow director 46 is disposed within said first position, limiting the flow therethrough from the fluid inlet 22 to the first fluid outlet 26. Upon rotating handle 68 ninety degrees so as to abut stop 76, the flow director 46 is disposed in the second position, whereupon water passes from the fluid inlet 22 through both fluid outlets 26 and 28.

Adjustable flow control shut-off valve 18 is of a conventional configuration for selectively allowing water to pass therethrough. In the preferred embodiment, shut-off valve 18 employs an elongated handle 78 which is operatively connected to a valve ball 82 within valve 18. Valve ball 82 has an aperture 84 extending therethrough such that upon aligning handle 80 with the longitudinal axis of shut-off valve 18, the aperture 84 in valve ball 82 is correspondingly aligned so as to allow water to pass therethrough. Upon rotating handle 78 toward a perpendicular disposition with respect to the longitudinal axis of shut-off valve 18, valve ball 82 is correspondingly rotated to incrementally restrict fluid flow through shut-off valve 18. Upon rotating handle 80 to a perpendicular disposition with respect to the longitudinal axis of shut-off valve 18, valve ball 82 is correspondingly rotated to prevent fluid flow through the shut-off valve 18. Accordingly, by coordinating the position of handle 78 in shut-off valve 18 with the disposition of the flow director 46 within the diverter valve 16, water can be directed from the fluid inlet 22 of the diverter valve either through both of the fluid outlets, through only one thereof, or shut off entirely.

The lower shower head 12 is pivotally mounted at the outlet end 90 of the shut-off valve 18 by ball joint 91. The lower end 92 of conduit 20 communicates with the second fluid outlet 28 of the diverter valve 16 thereon by means of a ball joint 29 such that the diverter valve 16, shut-off valve 18 and lower shower head 12 are carried by the lower end 92 of conduit 20 and the lower end 92 of conduit 20 can pivoted with respect to the diverter valve 16, shut-off valve 18, and the lower shower head 12. The upper shower head 14 is pivotally mounted on the upper end 96 of conduit 20 by means of ball joint 94. Due to the aforesaid pivotal mountings in combination with the substantially "S"-shaped configuration of connecting conduit 20, the angular orientation of the two shower heads can be individually adjusted and the orientation and height of the upper shower head with respect to the lower shower head can be readily adjusted, thereby allowing the shower head assembly 10 to be conveniently used by either one person with either a single conventional spray or, by activating both shower heads, two separate sprays can be concurrently directed against the user's front and back sides, or alternatively, by two persons concurrently. The diverter valve 16 and shut-off valve 18 also allow for selected interruption of the flow from each sprinkler for lathering. By restricting the total flow rate through the assembly, providing two separate shower heads with selective shut-offs and positioning the shower heads for convenient use by two people, substantial water-saving is achieved. It has been found that with two people showering at the same time using both shower heads as above described, the assembly effectively limits the total water flow to an established maximum rate and distributes the available water flow evenly through both heads, resulting in a fifty-percent water savings beyond established conservation requirements for each shower. Variation in the size of the centrally disposed aperture 88 in flow restrictor 80 alters the maximum flow rate through the assembly. Other variables being equal, larger apertures yield higher flow rates and smaller apertures yield lower flow rates. Thus, maximum total flow rates can be set to meet conservation codes and further conservation can be achieved through simultaneous showering by two persons, each at one-half the total allowable flow rate.

Various changes and modifications may be made in carrying out the present invention without departing from the spirit and scope thereof. Insofar as these changes and modifications are within the purview of the appended claims, they are to be considered as part of the present invention.

I claim:

1. A dual shower head assembly comprising a substantially "S"-shaped conduit defining an upper end and a lower end, a first shower head communicating with and pivotally mounted on the upper end of said conduit, a diverter valve assembly having a water inlet, a first water outlet, a second water outlet and selector means for selectively communicating said water inlet with either said first water outlet or with said first and second water outlets, said water inlet being adapted for fluid communication with a shower outlet fitting and said lower end of said conduit communicating with and being pivotally mounted on said second water outlet, a second shower head communicating with and being pivotally mounted with respect to said first water outlet, and an adjustable shut-off valve for selectively interrupting water flow from said second shower head, whereby through coordinating said selector means and said shut-off valve, water can be directed through said diverter valve to said first shower head, said second shower head, said first and second shower heads concurrently or to neither of said shower heads and upon pivoting said conduit with respect to said diverter valve, the height and angular orientation of said first shower head can be adjusted with respect to said second shower head for concurrent independent showering by two persons.

2. The assembly of claim 1 wherein said shut-off valve is disposed between said first water outlet of said diverter valve and said second shower head.

3. The assembly as in claims 1 or 2 wherein said diverter valve defines a cylindrical chamber therein, a first aperture communicating said chamber with said first water outlet, a second aperture communicating said chamber with said second water outlet and wherein said selector means comprises a cylindrical member rotatably mounted within said chamber, said member defining a first slot extending radially therethrough, a second slot extending radially therethrough and being perpendicularly disposed with respect to said first slot and a third slot extending radially therethrough, said third slot being disposed above and extending parallel to said second slot, and means for limiting the rotation of said selector member within said chamber between a first position and a second position such that upon disposing said cylindrical member in said first position, said first slot communicates said first aperture in said diverter valve with said first water outlet therein and upon disposing said cylindrical member in said second position, said second slot communicates said first aperture in said diverter valve with said first water outlet therein and said third slot communicates said fluid inlet with said second aperture in said diverter valve for directing water to said second fluid outlet.

4. The assembly of claim 3 including a disc member disposed in said diverter valve between said water inlet thereof and said chamber, said disc member defining an aperture therein for restricting the volume of water flow through said assembly.

5. A dual shower head assembly comprising a substantially "S"-shaped conduit defining an upper end and a lower end, a first shower head communicating with and pivotally mounted on the upper end of said conduit, a diverter valve assembly having a water inlet, a first water outlet, a second water outlet and selector means for selectively communicating said water inlet with either said first water outlet or with said first and second water outlets, said water inlet being adapted for fluid communication with a shower outlet fitting and said lower end of said conduit communicating with and being pivotally mounted on said second water outlet, an adjustable shut-off valve communicating with and carried by said first water outlet of said diverter valve for selectively interrupting water flow from said first water outlet through said shut-off valve, and a second shower head communicating with and pivotally mounted on said shut-off valve whereby through coordinating said selector means and said stop valves, water can be directed through said diverter valve to said first shower head, said second shower head, said first and second shower heads concurrently or to neither of said shower heads and upon pivoting said conduit with respect to said diverter valve, the height and angular orientation of said first shower head can be adjusted with respect to said second shower head for concurrent independent showering by two person.

6. The assembly of claim 5 wherein said diverter valve defines a cylindrical chamber therein, a first aperture communicating said chamber with said first water outlet, a second aperture communicating said chamber with said second water outlet and wherein said selector means comprises a cylindrical member rotatably mounted within said chamber, said member defining a first slot extending radially therethrough, a second slot extending radially therethrough and being perpendicularly disposed with respect to said first slot and a third slot extending radially therethrough, said third slot being disposed above and extending parallel to said second slot, and means for limiting the rotation of said selector member within said chamber between a first position and a second position such that upon disposing said cylindrical member in said first position, said first slot communicates said first aperture in said diverter valve with said first water outlet therein and upon disposing said cylindrical member in said second position, said second slot communicates said first aperture in said diverter valve with said first water outlet therein and said third slot communicates said fluid inlet with said second aperture in said diverter valve for directing water to said second fluid outlet.

7. The assembly of claim 6 including a disc member disposed in said diverter valve between said water inlet thereof and said chamber, said disc member defining an aperture therein for restricting the volume of water flow through said assembly.

* * * * *